US005787511A

United States Patent [19]

Garside

[11] Patent Number: 5,787,511

[45] Date of Patent: Aug. 4, 1998

[54] TEMPORARY HEMMING DEVICE

[76] Inventor: Sandra-Vernida Ray King Garside, 816 Kennedy St., NE., Washington, D.C. 20011-2731

[21] Appl. No.: 753,114

[22] Filed: Nov. 20, 1996

[51] Int. Cl.[6] ..... A41D 27/10; A41D 1/06

[52] U.S. Cl. ..... 2/269; 2/232; 223/1

[58] Field of Search ..... 223/1; 24/707.05; 2/269, 232

[56] References Cited

U.S. PATENT DOCUMENTS

| | | | |
|---|---|---|---|
| 2,497,305 | 2/1950 | Isaac et al. | 24/707.5 |
| 2,677,829 | 5/1954 | Rothstein et al. | 2/232 |
| 3,947,896 | 4/1976 | Taylor | 2/269 |
| 4,149,275 | 4/1979 | Sanchez | 2/269 |
| 4,602,389 | 7/1986 | Brown | 2/269 |
| 5,006,393 | 4/1991 | Isoe | 2/269 |
| 5,008,128 | 4/1991 | Kape | 2/269 |

*Primary Examiner*—Bibhu Mohanty

[57] ABSTRACT

A temporary hemming device includes a flexible member having a first end and a second end and being made of a material which feels comfortable on skin, and a fastening device for fastening the first end to the second end through a garment, wherein the fastening device comprises a first part and a second part, wherein the first part is attached to the first end and the second part is attached to the second end. A method for making a temporary hem includes folding an edge of a garment, placing a temporary hemming device over the folded edge, and affixing the temporary hemming device to make the temporary hem. A temporary hemming device includes a folded edge of a garment and a temporary hemming device securing the folded edge in place.

14 Claims, 2 Drawing Sheets

TEMPORARY HEMMING DEVICE

FIELD OF THE INVENTION

This invention relates to a device for making a hem, more particularly to a temporary hemming device, a temporary hem, and a method for making a temporary hem.

BACKGROUND OF THE INVENTION

In the clothing art, there is often the need to adjust the length of a garment. A typical way that the length of a garment has been adjusted is through the use of a hem. A hem in the clothing art has been formed by folding under the edge of a garment and then sewing down the edge to thereby shorten the garment.

However, there is a major drawback in the aforementioned hemming technique, in that it takes a relatively significant amount of time and effort to make the hem, such that it is not suitable if one desires only a temporary hem. That is, there are times when one desires to adjust the length of a garment for only a limited duration.

For example, if a person wants to wear a pair of pants with high-heeled shoes some times and flat shoes at other times, that person might wish to wear the pants in an unhemmed state with the flat shoes. If that person frequently alternates between wearing flat shoes and wearing high-heeled shoes, there is a need to be hemming and unhemming the pants frequently.

As one way of satisfying this need, pins can be used to form a temporary hem. However, the use of pins is not particularly attractive and thus is not a desirable option. Thus, there is a need in the art to develop a better way of forming a temporary hem.

As another example, a person may wish to temporarily shorten the length of the sleeves or the body of a shirt. In such an instance, that person might simply push up the sleeves or roll up the body of the shirt. However, there is a tendency for the sleeves or body of the shirt to lengthen prematurely in such a case. Thus, there is a need in the art for a temporary hem which can be easily formed.

SUMMARY OF THE INVENTION

An object of the present invention is to provide an improved temporary hem that is easily reversible, a method for making such a hem, and a device useful for making such a hem.

The above and other objects of the present invention are provided by:

A temporary hemming device comprising a flexible member having a first end and a second end, and being made of a material which feels comfortable on skin, and a fastening device for fastening the first end to the second end through a garment, wherein said fastening device comprises a first part and a second part, wherein the first part is attached to the first end and the second part is attached to the second end.

A method for making a temporary hem comprising folding an edge of a garment to form a folded edge to shorten the garment, and placing a temporary hemming device over the folded edge to prevent the folded edge from unfolding, wherein the temporary hemming device comprises a flexible member having a first end and a second end, and being made of a material which feels comfortable on skin, and a fastening device for fastening the first end to the second end through a garment, wherein said fastening device comprises a first part and a second part, wherein the first part is attached to the first end and the second part is attached to the second end, and 3. Affixing the temporary hemming device to make a temporary hem by fastening the first end of the temporary hemming device to the second end of the temporary hemming device through the garment, and a temporary hem comprising a folded edge of a garment and a temporary hemming device securing the folded edge in place, wherein the temporary hemming device comprises a flexible member having a first end and a second end, and being made of a material which feels comfortable on skin, and a fastening device for fastening the first end to the second end through a garment, wherein said fastening device comprises a first part and a second part, wherein the first part is attached to the first end and the second part is attached to the second end. Affixing the temporary hemming device to make a temporary hem by fastening the first end of the temporary hemming device through the garment.

DETAILED DESCRIPTION OF THE INVENTION

In the temporary hemming device of the present invention, the flexible member can be made of any suitable material, as long as it feels comfortable to the skin and is capable of forming a temporary hem. One example is cloth. A second example is leather. A third example is beads, which provide a more elegant appearance.

The flexible member can be any suitable length and width, as long as it is able to be used to form a temporary hem. For example, the length can range from 6" to 10", preferably from 6" to 8"; and the width can range from 0.5" to 1.5", preferably from 0.5" to 1".

The fastening device can be any suitable fastening device which is capable of being used in conjunction with the flexible material to form a temporary hem. The fastening device must be capable of securing one end of the flexible material to the other through the garment being temporarily hemmed. An example of a suitable fastening device is a butterfly pin, tie tack pin, or clutch pin.

Figure 1:
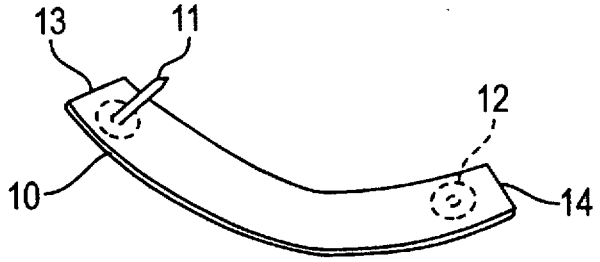
FIG. 1 shows one embodiment of the device of the present invention.

An embodiment of the temporary hemming device is shown in FIG. 1. In FIG. 1, the device is made of a flexible material 10, a fastening device first part 11, and a fastening device second part 12. The first part 11 is attached to the flexible material first end 13, and the second part 12 is attached to the flexible material second end 14.

Also, the present invention provides a temporary hemming device for shortening the length of an article of clothing. The article of clothing can be a man's or woman's pant legs or shirt or sweater sleeve which when pushed up or creased under are prevented from rolling down.

Figure 2:
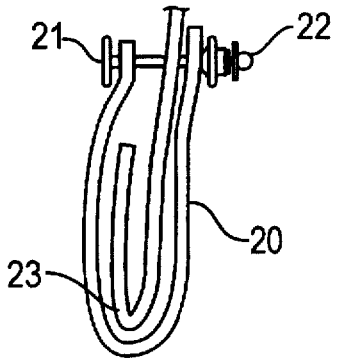
FIG. 2 shows one type of temporary hem that can be formed according to the present invention.

A temporary hem can be formed as shown in FIG. 2. In FIG. 2, a fastening device first part 21 and a fastening device second part 22 of a temporary hemming device 20 have been fastened through a garment having a folded edge 23 so as to secure the folded edge.

Various garments can be temporarily hemmed. One garment is a pair of pants, in which the pants legs can be temporarily hemmed. Another garment is a shirt, in which the shirt bottom and the sleeves can be temporarily hemmed.

Figure 3:
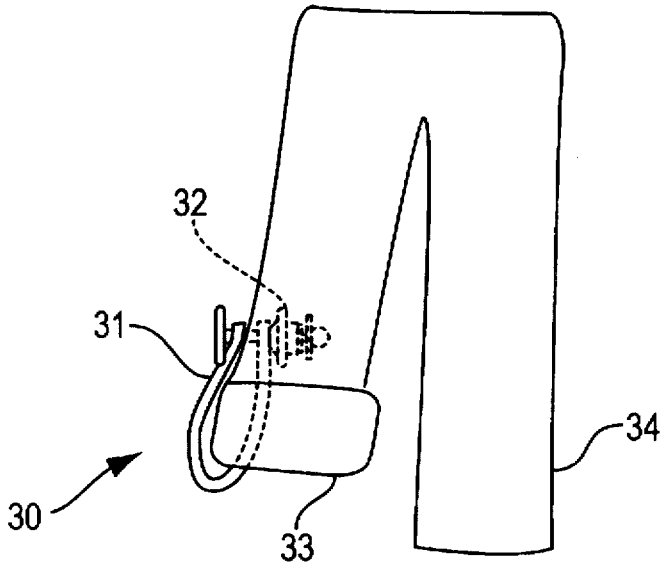
FIG. 3 shows a pair of pants with a temporary hem according to the present invention.

FIG. 3 shows a pair of pants in which one leg has been temporarily hemmed for illustrative purposes. In FIG. 3, a fastening device first part 31 and a fastening device second part 32 of a temporary hemming device 30 have been fastened through a pair of pants having a folded pants leg 33 so as to secure the folded pants leg. An unfolded pants leg 34 is shown to illustrate how the temporary hemming device is used to shorten a pants leg.

Figure 4:
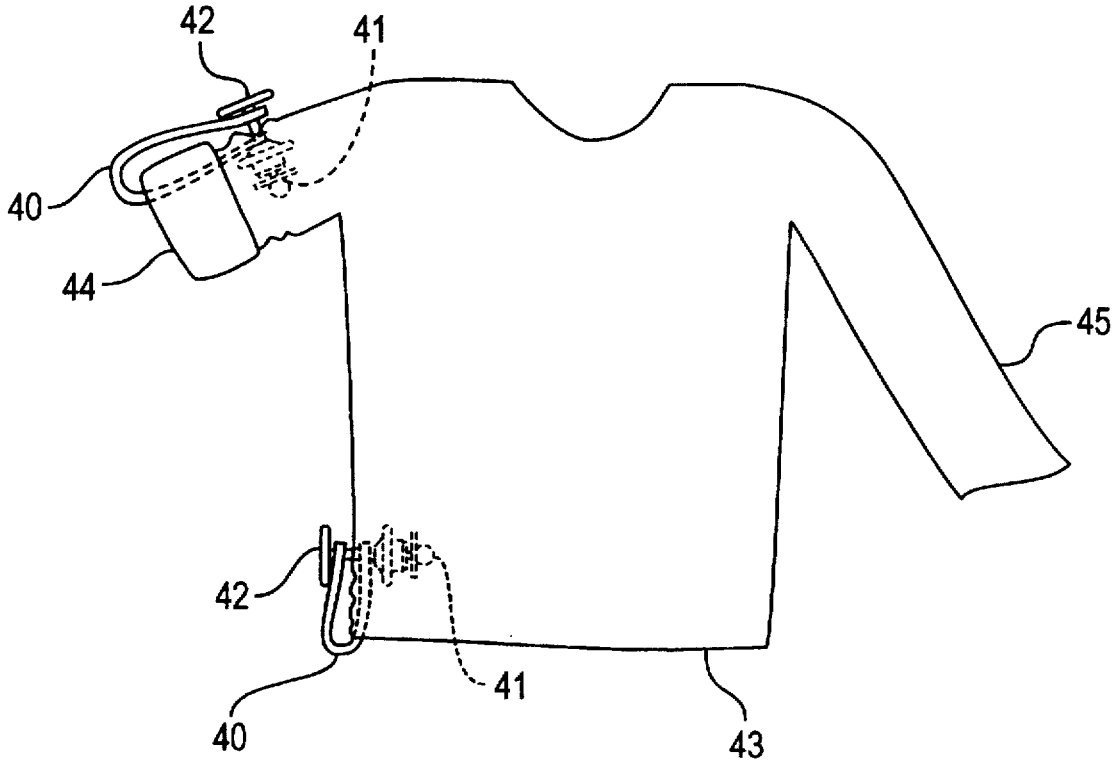
FIG. 4 shows a shirt with temporary hems according to the present invention.

FIG. 4 shows a shirt in which the shirt bottom has been temporarily hemmed and in which one shirt sleeve has been temporarily hemmed for illustrative purposes. In FIG. 4, a fastening device first part 41 and a fastening device second part 42 of a temporary hemming device 40 have been fastened through a shirt having a folded shirt bottom edge 43 and a folded sleeve edge 44 so as to secure the folded shirt bottom edge and the folded sleeve edge, respectively. An unfolded sleeve 45 is shown to illustrate how the temporary hemming device is used to shorten the length of a sleeve. Also, FIG. 4 shows that the edge to be temporarily hemmed can be folded inside the garment (as illustrated by folded shirt bottom edge 43) or outside the garment (as illustrated by folded sleeve edge 44).

While the invention has been described in detail along with supporting examples thereof, it will be apparent to one skilled in the art that some modifications can be made without departing from the spirit and scope thereof.

What is claimed is:

1. A temporary hem comprising a folded edge of a garment and a temporary hemming device securing the folded edge in place, wherein the temporary hemming device comprises a flexible member having a first end and a second end, and being made of a material which feels comfortable on skin, and a fastening device for fastening the first end to the second end through a garment, wherein said fastening device comprises a first part and a second part, wherein the first part is attached to the first end and the second part is attached to the second end.

2. A temporary hem as in claim 1, wherein the edge is a pants leg edge.

3. A temporary hem as in claim 1, wherein the edge is a sleeve edge.

4. A temporary hem as in claim 1, wherein the edge is a shirt bottom edge.

5. A temporary hem as in claim 1, wherein the flexible member is made from fabric.

6. A temporary hem as in claim 1, wherein the flexible member is made from leather.

7. A temporary hem as in claim 1, wherein the flexible member is made from beads.

8. A method of making a temporary hem in a garment comprising:

providing a garment with an edge which is desired to be hemmed and then folding the garment's edge to the desired hemmed length, providing a separate temporary hemming device comprising a flexible member with a first end with a first interlocking part and a second end with a second interlocking part, placing the temporary hemming device over the folded edge and bending the flexible member and then interlocking the first and second parts together to hold the hem temporarily in the device.

9. A method as in claim 8, wherein the edge is a pants leg edge.

10. A method as in claim 8, wherein the edge is a sleeve edge.

11. A method as in claim 8, wherein the edge is a shirt bottom edge.

12. A method as in claim 8, wherein the flexible member is made from fabric.

13. A method as in claim 8, wherein the flexible member is made from leather.

14. A method as in claim 8, wherein the flexible member is made from beads.

* * * * *